United States Patent [19]

Slaven

[11] Patent Number: 5,049,086

[45] Date of Patent: Sep. 17, 1991

[54] LOCKING WALL PLATE AND PLUG APPARATUS

[76] Inventor: Donald E. Slaven, 260 S. Litchfield Rd., #C132, Litchfield Park, Ariz. 85340

[21] Appl. No.: 644,276

[22] Filed: Jan. 22, 1991

[51] Int. Cl.[5] ..... H01R 13/44

[52] U.S. Cl. ..... 439/143; 174/67; 439/144; 439/147; 439/373

[58] Field of Search ..... 174/67; 439/137-139, 439/143-145, 147, 332, 372, 373

[56] References Cited

U.S. PATENT DOCUMENTS

| | | | |
|---|---|---|---|
| 2,498,642 | 2/1950 | Bellek | 174/67 |
| 2,532,219 | 11/1950 | Bierce | 174/67 |
| 2,641,627 | 6/1953 | Lewis | 174/67 |
| 2,716,225 | 8/1955 | McCubbin | 439/373 |

*Primary Examiner*—Paula A. Bradley
*Attorney, Agent, or Firm*—Leon Gilden

[57] ABSTRACT

An apparatus including a plug mounting a lock plate thereon, wherein the lock plate includes a plurality of downwardly appending locking links spaced apart a predetermined diameter. The mounting plate of the apparatus includes at least one rotatable outlet plate mounted within an associated annular opening captured therewithin. The outlet plate includes a plurality of spaced locking slots spaced apart at a predetermined diameter to receive the locking legs therewithin when the outlet plate is rotated from a horizontal first position to a vertical second position to align the locking legs with the locking slots.

5 Claims, 5 Drawing Sheets

Fig 8
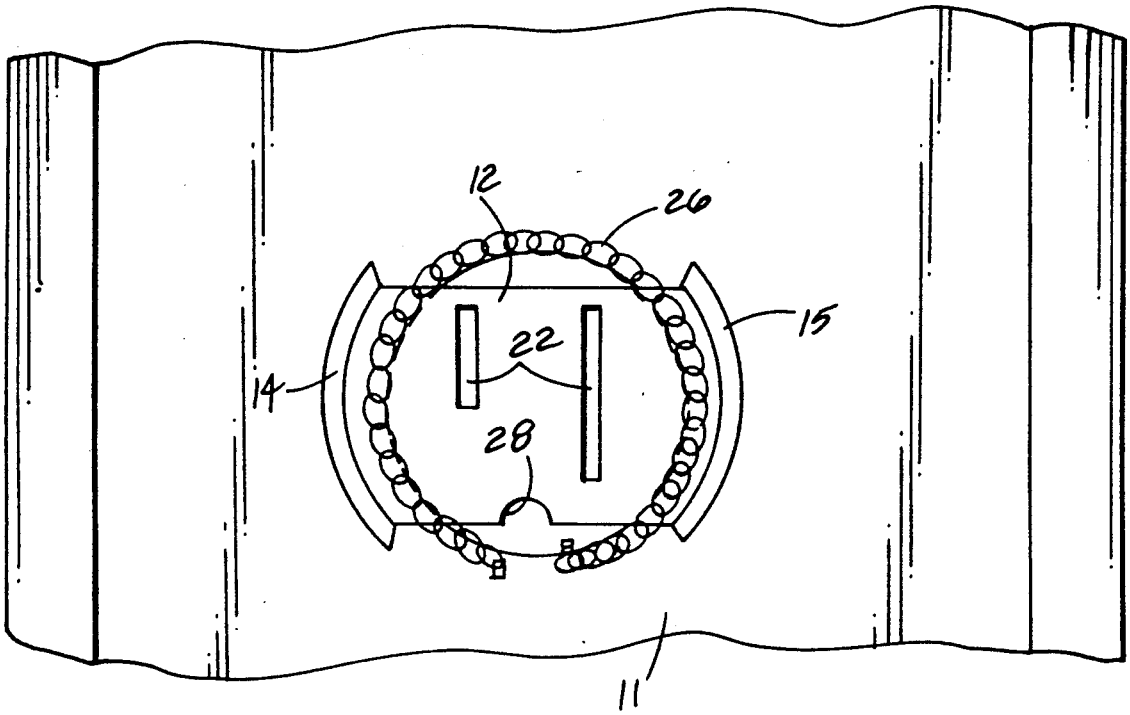
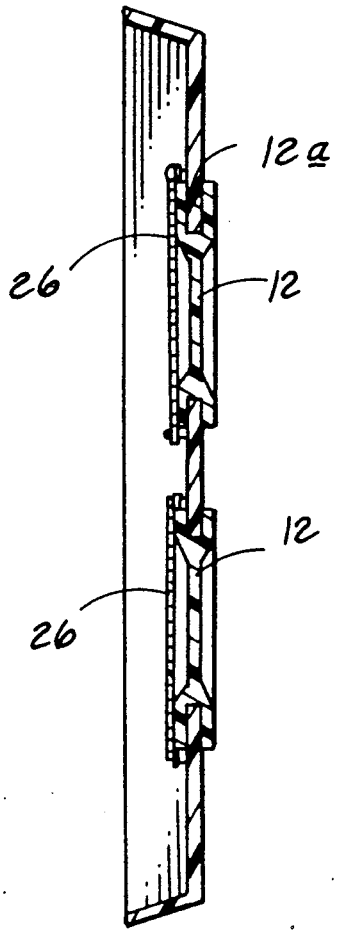
Fig 9

LOCKING WALL PLATE AND PLUG APPARATUS

BACKGROUND OF THE INVENTION

1. Field of the Invention

The field of invention relates to outlet receptacles, and more particularly pertains to a new and improved locking wall plate and plug apparatus wherein the same discourages access to electrical contacts within an outlet receptacle prior to rotation of receptacle by an associated plug.

2. Description of the Prior Art

Prior art has addressed a current issue in attempting to discourage and prevent children to direct various objects within outlet receptacles with dangerous results. To discourage such access, various blank plug arrangements and covering organizations have been utilized in the prior art to attempt to cover the outlet and prevent a child from gaining access thereto. The instant invention sets forth an apparatus utilizing a unique locking plug cooperative with the outlet receptacle to orient the electrical components of the receptacle into association with the plug only upon insertion of the plug and rotation thereof within the receptacle. Prior art organizations of receptacles incorporating locking features may be found in U.S. Pat. No. 4,789,353 to Busta, et al. wherein electrical plug retainer utilizes a bracket mounting the outlet plug into association with the receptacle utilizing biasing means in association with the bracket to secure the plug in a desired orientation.

U.S. Pat. No. 2,891,103 to Swengel sets forth an electrical contact block wherein the block includes a plurality of legs arranged for securement within an opening within a wall or support surface aligning the plug for operative association with a companion plug to align respective electrical components therewithin.

U.S. Pat. No. 4,061,407 to Snow sets forth an electrical connector assembly wherein the same utilizes a plug mounted within a socket wherein a plate cover overlying the plug includes a locking leg to secure and position the plug relative to the socket.

U.S. Pat. No. 1,143,536 to Goodridge sets forth an attachment plug fitting wherein the plug employs a plurality of legs receivable within clips positioned at adjacent sides of the plug to align the plug relative to an associated receptacle.

As such, it may be appreciated that there continues to be a need for a new and improved locking wall plate and plug apparatus as set forth by the instant invention which addresses both the problems of ease of use as well as effectiveness in construction in providing electrical association with a plug and receptacle subsequent only to proper orientation of the plug and receptacle relative to one another.

SUMMARY OF THE INVENTION

In view of the foregoing disadvantages inherent in the known types of receptacle apparatus now present in the prior art, the present invention provides a locking wall plate and plug apparatus wherein the same utilizes an electrical plug including a locking plate wherein the locking plate is cooperative with locking slots within an associated electrical receptacle or plate to fixedly secure and lock the plug relative to the receptacle. As such, the general purpose of the present invention, which will be described subsequently in greater detail, is to provide a new and improved locking wall plate and plug apparatus which has all the advantages of the prior art electrical outlet apparatus and none of the disadvantages.

To attain this, the present invention includes an apparatus including a plug mounting a lock plate thereon, wherein the lock plate includes a plurality of downwardly appending locking links spaced apart a predetermined diameter. The mounting plate of the apparatus includes at least one rotatable outlet plate mounted within an associated annular opening in capture therewithin. The outlet plate includes a plurality of spaced locking slots spaced apart a predetermined diameter to receive the locking legs therewithin when the outlet plate is rotated from a horizontal first position to a vertical second position to align the locking legs with the locking slots.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved locking wall plate and plug apparatus which has all the advantages of the prior art electrical outlet organizations and none of the disadvantages.

It is another object of the present invention to provide a new and improved locking wall plate and plug apparatus which may be easily and efficiently manufactured and marketed.

It is a further object of the present invention to provide a new and improved locking wall plate and plug apparatus which is of a durable and reliable construction.

An even further object of the present invention is to provide a new and improved locking wall plate and plug apparatus which is susceptible of a low cost of manufacture with regard to both materials and labor, and which accordingly is then susceptible of low prices of sale to the consuming public, thereby making such locking wall plate and plug apparatus economically available to the buying public.

Still yet another object of the present invention is to provide a new and improved locking wall plate and plug apparatus which provides in the apparatuses and methods of the prior art some of the advantages thereof, while simultaneously overcoming some of the disadvantages normally associated therewith.

Still another object of the present invention is to provide a new and improved locking wall plate and plug apparatus wherein the same permits electrical association of an electrical outlet and associated plug only upon proper registration and orientation of the plug relative to the receptacle to permit a locking orientation between the plug and receptacle apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic rear view of the mounting plate and associated outlet plate in a second position.

FIG. 9 is an orthographic cross-sectional view, taken along the lines 9—9 of FIG. 6 in the direction indicated by the arrows.

DESCRIPTION OF THE PREFERRED EMBODIMENT

Figure 1:
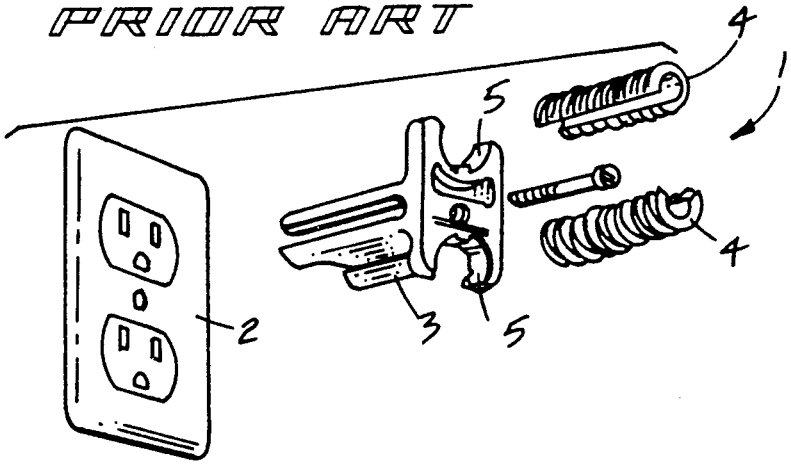
Fig 1 PRIOR ART
FIG. 1 is an isometric illustration of a prior art electrical outlet organization.

With reference now to the drawings, and in particular to FIGS. 1 to 10 thereof, a new and improved locking plate and plug apparatus embodying the principles and concepts of the present invention and generally designated by the reference numeral 10 will be described.

Figure 2:
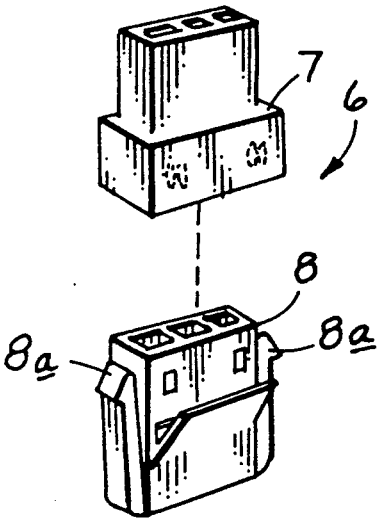
Fig 2 PRIOR ART
FIG. 2 is an isometric illustration of a prior art electrical connector plug assembly.
Figure 3:
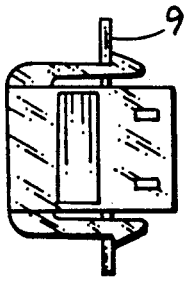
Fig 3 PRIOR ART
FIG. 3 is an orthographic top view of the electical plug assembly, as set forth in FIG. 2, mounted into an associated support plate.

FIG. 1 illustrates a prior art outlet apparatus 1, wherein electrical outlet 2 mounts a bracket 3, including a plurality of arcuate recesses 5 formed within a forward end thereof to receive associated locking barrels 4, wherein the locking barrels 4 secure an outlet plug (not shown) between each barrel and the associated receptacle 2. FIG. 2 illustrates a further prior art electrical plug connection apparatus 6 wherein a first plug member 7 receives a second plug member 8. The second plug member 8 includes a plurality of legs **8*a* for locking securement within a support planar wall 9, as illustrated in FIG. 3**.

Figure 4:
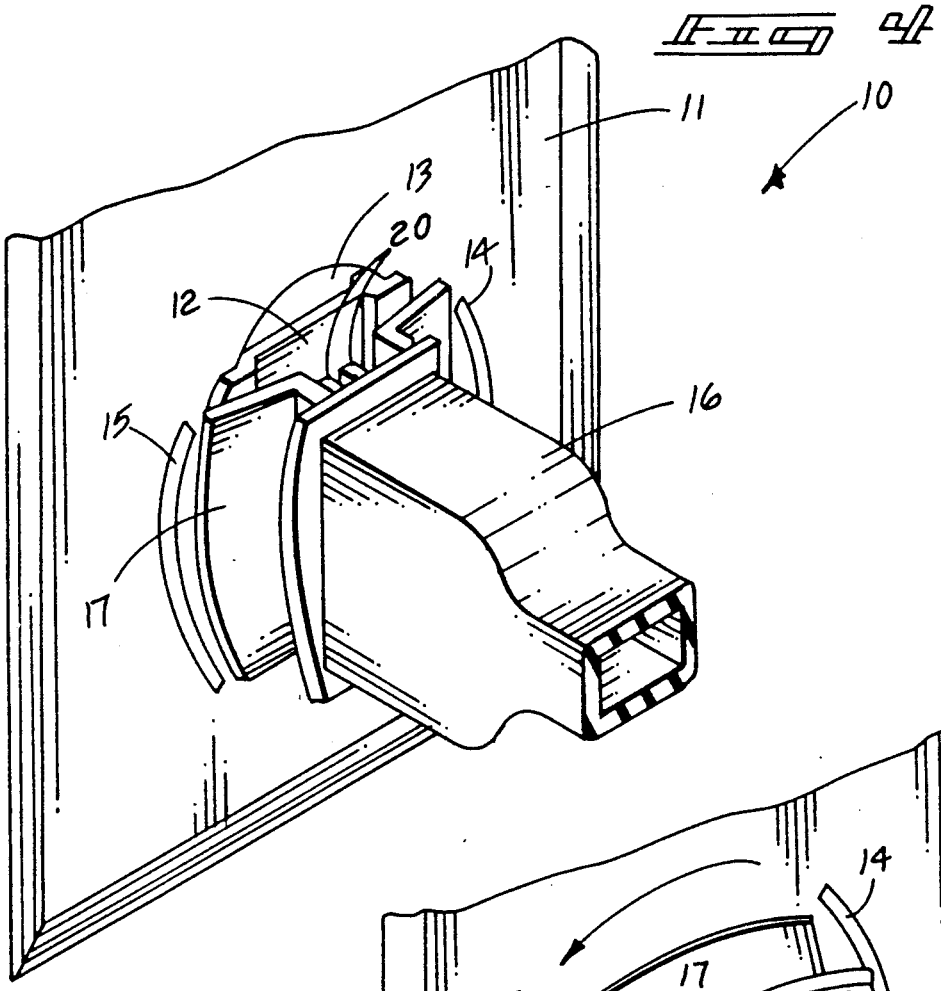
FIG. 4 is an isometric illustration of the instant invention in a first position.
Figure 5:
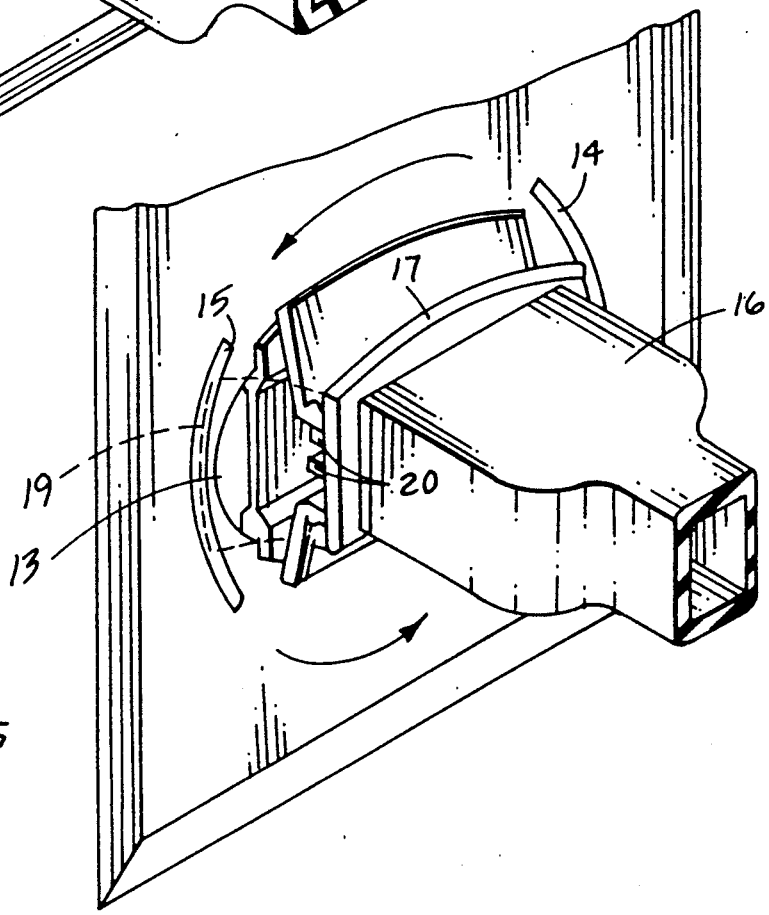
FIG. 5 is an isometric illustration of the instant invention in a second position.
Figure 6:
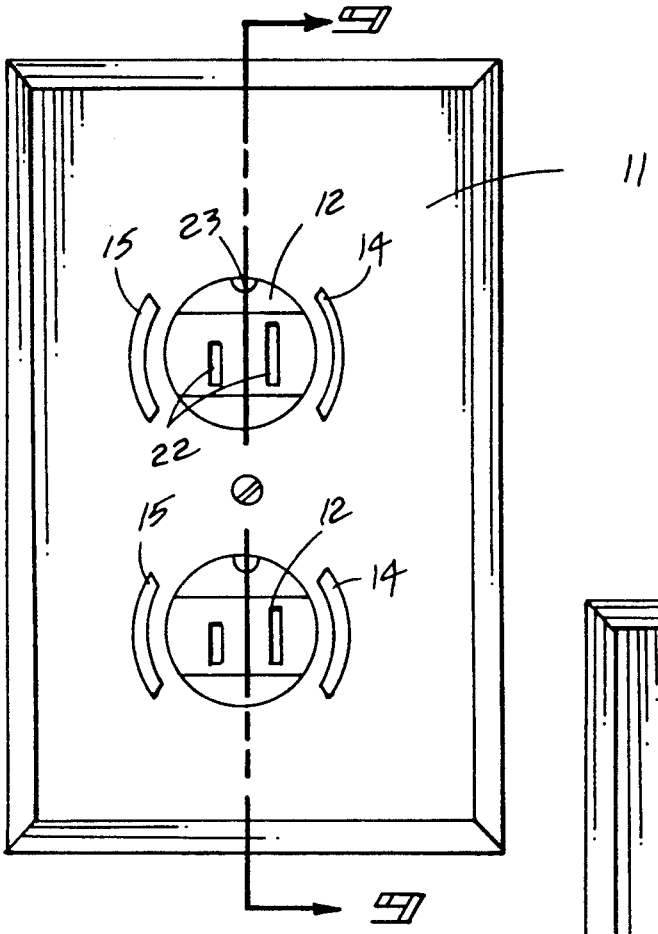
FIG. 6 is an orthographic front view, taken in elevation, of the mounting plate of the instant invention in a first position.
Figure 10:
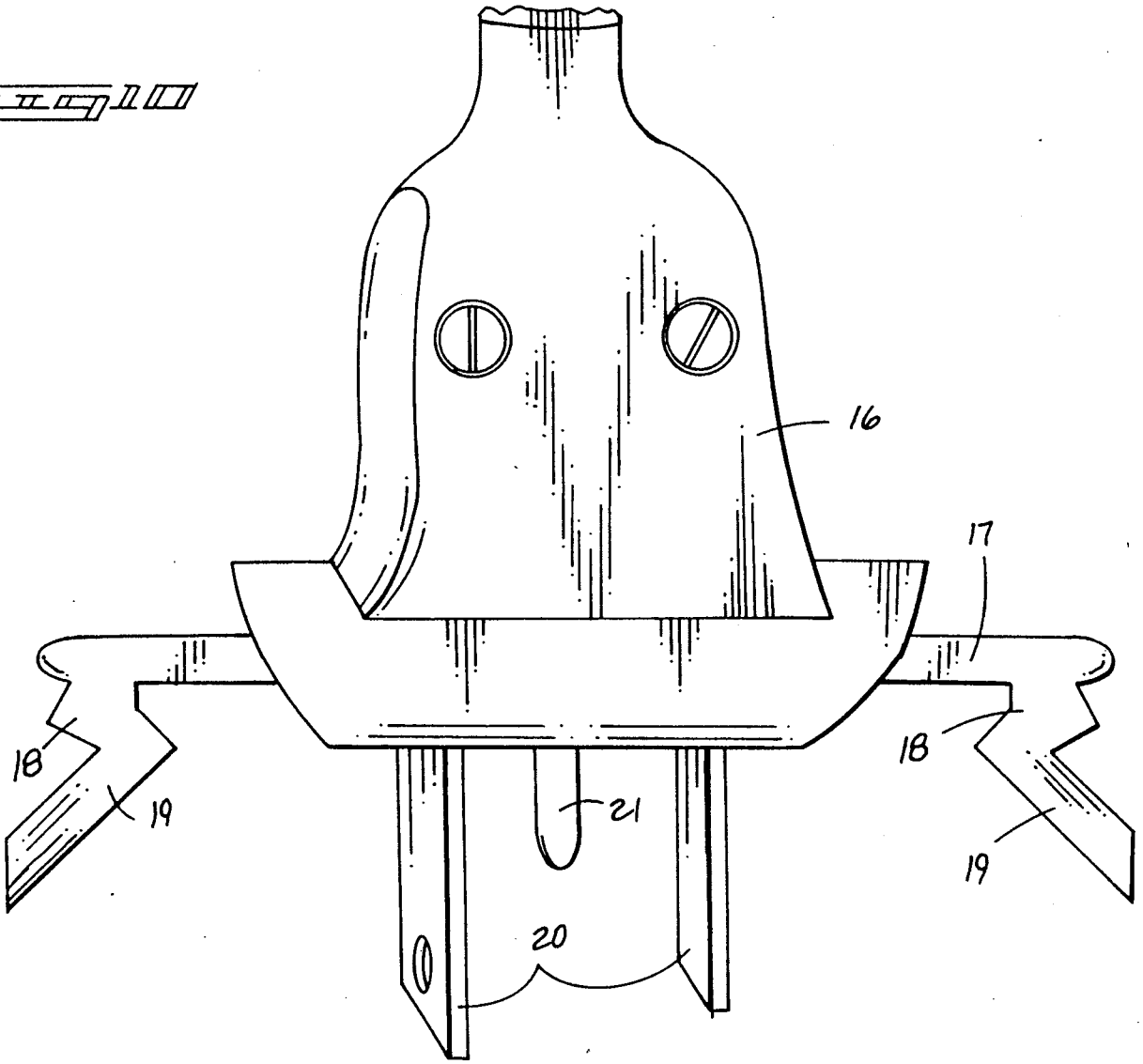
FIG. 10 is an orthographic side view of the electrical plug utilized by the instant invention.

More specifically, the locking wall plate and plug apparatus 10 of the instant invention essentially comprises a mounting plate 11, including at least one rotatable outlet plate 12 mounted for selective rotation within an associated annular opening 13. The annular opening includes a right annular locking slot 14 and a left annular locking slot 15 positioned at opposed sides of the annular opening 13, wherein the right and left annular locking slots 14 and 15 are spaced apart a predetermined diameter therebetween and each define a predetermined arc of opening. Reference to FIGS. 4, 5, and 10 illustrate the electrical plug member utilized by the instant invention that includes a lock plate 17 orthogonally and integrally mounted to a forward end of the plug member 16, wherein the locking plate 17 includes a plurality of locking legs 18, each include outwardly directed locking tabs 19 mounted at forward terminal ends of each locking leg 18. The locking legs each are spaced apart the aforenoted predetermined arc defined by the locking slots 14 and 15 as noted above. The plug member 16 includes a conventional plurality of parallel electrical prongs 20 and an underlying ground prong 21. The prongs 20 are receivable within parallel prong receiving slots 22 formed within the rotatable outlet plate 12 and upon rotation of the outlet plate 12 from a first vertical position to a second horizontal position, in a manner as illustrated in FIGS. 4, 5, and 8 for example, a ground prong opening 23 is aligned with an associated semi-cylindrical recess 28 formed within a lower terminal edge of the rotatable outlet plate 12 to permit access of the ground prong 21 within an associated ground prong opening 23 formed through the annular opening 13 to complete electrical association of the various prongs of the electrical plug member 16.

It should be noted that the locking legs 18 are only aligned in registration with the associated locking slots 14 and 15 upon proper orientation registration of the outlet plate 12 from the first position to the second position as noted above, and as illustrated in phantom in FIG. 5.

Reference to FIG. 9 illustrates the outlet plate 12 defined by a circumferential groove defined by a bifurcated end portion **12*a* rotatably receiving an annular flange of the mounting plate 11 therewithin. An annular biasing spring 26 mounted within an annular track is mounted to the outlet plate to normally bias the outlet plate in the first vertical position to require manual repositioning of the outlet plate from the first vertical position to the second horizontal position, as illustrated in FIGS. 4 and 5. Accordingly, the biasing spring 26 is mounted to a first projection secured to the outlet plate 12 and a second position secured to a rear surface of the mounting plate 11 to effect biasing of the outlet plate 12** in the first vertical position.

FIG. 9 illustrates that the rotatable outlet plate 12 includes the bifurcated end portion **12*a* at diametrically opposed ends of the outlet plate 12 to capture the mounting plate 11 within each bifurcated end portions 12*a* and accordingly permit relative rotation of the outlet plate 12 relative to the annular opening 13**.

Figure 7:
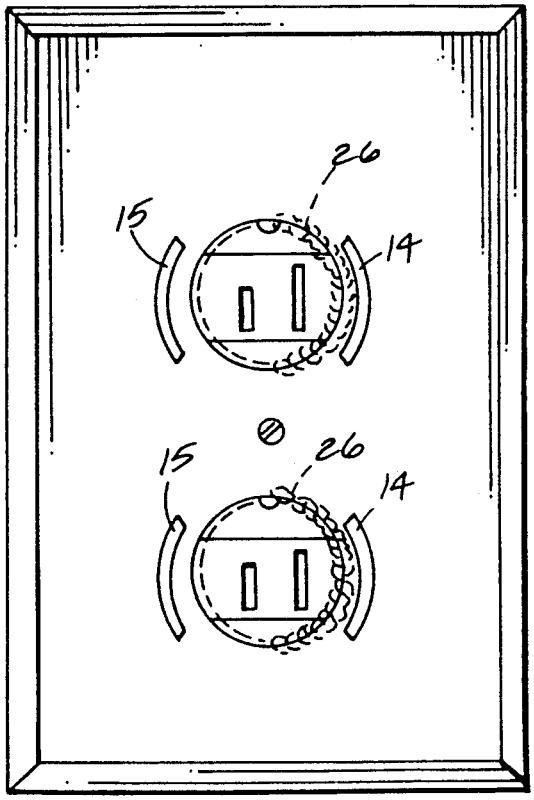
FIG. 7 is an orthographic rear view, taken in elevation, of the mounting plate in the first position.

It should be noted that the biasing spring 26 is extended from a semi-annular configuration when the respective outlet plate 12 is in the first vertical position to a substantially circular configuration when the outlet plate 12 is rotated to a horizontal position, as illustrated in FIGS. 7 and 8 for example, to permit registration of the tabs 19 within the respective locking slots 14 and 15.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A locking wall plate and plug apparatus comprising, in combination, a mounting plate, the mounting plate including at least one annular opening, the annular opening including a rotatable outlet plate captured within the annular opening and rotatable from a first vertical position to a second vertical position, the rotatable outlet plate including a plurality of spaced parallel electrical prong receiving slots wherein the prong receiving slots are in a vertical orientation in the first position and in a vertical orientation in the second position mounted within the rotatable outlet plate, and an electrical plug member, the electrical plug member including a lock plate fixedly mounted to a forward end of the electrical plug member, and the electrical plug member including a plurality of locking legs orthogonally mounted and forwardly directed of the locking plate, and the locking legs spaced apart a predetermined diameter, and a plurality of electrical prongs mounted to the electrical plug member between the locking legs and directed forwardly of the lock plate, and the annular opening including a right and left annular locking slot wherein the locking legs are receivable within the locking slots in the second position and are displaced from the locking slots in the first position.

2. An apparatus as set forth in claim 1 wherein the locking slots are spaced apart a predetermined diameter and are defined by a predetermined arc of opening, and the locking legs defined a predetermined arc substantially equal to the predetermined arc of opening.

3. An apparatus as set forth in claim 2 wherein the locking legs each include an outwardly directed locking tab, wherein each locking tab and each locking leg are receivable within a respective locking slot when the rotatable outlet plate and plug member are in the second position.

4. An apparatus as set forth in claim 3 wherein the outlet plate includes a bifurcated end portion formed at opposed longitudinal sides of the outlet plate, wherein each bifurcated end portion captures and receives the mounting plate about the annular openings to position the outlet plate within the annular opening relative to the mounting plate.

5. An apparatus as set forth in claim 4 wherein the outlet plate includes an outlet plate biasing spring, the outlet plate biasing spring including a first end secured to the outlet plate and the second end secured to the mounting plate, and the biasing spring mounted within an annular track, wherein the biasing spring is arranged in a generally semi-annular configuration in a first position and stretched to a substantially annular configuration in the second position.

* * * * *